US007029244B2

(12) United States Patent
Anderson

(10) Patent No.: US 7,029,244 B2
(45) Date of Patent: Apr. 18, 2006

(54) HIGH-SPEED, BELT-DRIVEN INDUSTRIAL BLOWER

(75) Inventor: Robert B. Anderson, Ventura, CA (US)

(73) Assignee: Vortech Engineering, Inc., Oxnard, CA (US)

( * ) Notice: Subject to any disclaimer, the term of this patent is extended or adjusted under 35 U.S.C. 154(b) by 308 days.

(21) Appl. No.: 10/407,718

(22) Filed: Apr. 4, 2003

(65) Prior Publication Data

US 2003/0190242 A1 Oct. 9, 2003

Related U.S. Application Data

(60) Provisional application No. 60/369,736, filed on Apr. 4, 2002.

(51) Int. Cl.
*F04B 17/00* (2006.01)

(52) U.S. Cl. ..... 417/362; 417/423.8

(58) Field of Classification Search ..... 417/362, 417/423.8, 423.7, 423.14
See application file for complete search history.

(56) References Cited

U.S. PATENT DOCUMENTS

| | | | | |
|---|---|---|---|---|
| 2,279,620 | A * | 4/1942 | Hirschman | 417/368 |
| 3,392,910 | A * | 7/1968 | Tanzberger | 415/111 |
| 3,929,285 | A * | 12/1975 | Daugherty, Jr. | 236/13 |
| 4,869,641 | A * | 9/1989 | Hufgard | 415/121.2 |
| 5,161,939 | A * | 11/1992 | Stadler | 415/60 |

* cited by examiner

*Primary Examiner*—Charles G. Freay
(74) *Attorney, Agent, or Firm*—Kelly Lowry & Kelley, LLP

(57) ABSTRACT

A centrifugal blower is provided which incorporates a self-contained air cooling system. The blower includes a drive assembly connected to a drive motor and disposed within a housing having inlet and outlet apertures. A centrifugal compressor is connected to the drive assembly and disposed exteriorly to the housing adjacent to the outlet apertures. Rotation of a drive pulley, including a fan, by the drive motor causes air to enter the housing through the inlet apertures, flow over components of the drive assembly, and exit through the outlet apertures. A spindle assembly having a rigid bearing arrangement is also provided. One or more bearing elements are disposed at opposite ends of a spacer and between a shaft and housing of the spindle assembly. Such rigid pre-loaded bearing arrangement eliminates "unloading" concerns, and allows load sharing between bearing elements.

33 Claims, 11 Drawing Sheets

HIGH-SPEED, BELT-DRIVEN INDUSTRIAL BLOWER

RELATED APPLICATION

This application claims priority from U.S. Provisional Application Ser. No. 60/369,736, filed Apr. 4, 2002.

BACKGROUND OF THE INVENTION

The present invention generally relates to industrial blowers. More particularly, the present invention relates to a high-speed, belt-driven blower having an improved spindle assembly and an air cooling system in order to cool various components of the blower and improve the reliability and durability of the blower.

Compact belt-driven centrifugal blowers are commonly used in air drying and blow-off applications. These types of applications include aqueous-based in-line process cleaners which are used in a variety of manufacturing industries, consisting of wash and blow-off/dry cycles all in one self-contained machine. Other applications include ultra-high performance air knives, high volume blow-off, and de-watering applications typical with canning, beverage and electronic industries. Such blowers are also used in air evacuation, aeration and large fluidized beds. Advantages of the belt-driven centrifugal blowers are primarily improved efficiency over other types of blowers, such as so-called regenerative blowers, and perhaps just as important, the ability to maintain pressure delivery at the more useful higher flowrates.

Current blower products are all very similar in design and performance, and all suffer from the same performance limitations. One such design plan is the containment of the high-speed impeller spindle assembly (bearing) housing within the compressed-air collector housing. Understanding that air compression necessarily raises the process gas (air) temperature, the spindle housing and thus the critical high-speed bearing elements are exposed directly to the hotter compressed-air stream, limiting not only delivery pressures (i.e., gas or air temperature rise) but also the ability to manage thermal dissipation in the critical precision bearing elements. Increased bearing operating temperature has been shown to reduce overall life, shorten lubricant life and pose limitations on speed. As a rule, a 20° F. rise in operating temperature will generally reduce lubricant life by a factor of one-half. All of the current art products incorporate this design, and hence all suffer from the same shortcomings. As such, current art designs employ larger diameter impeller wheels, offsetting with slower rotational operating speeds. This scheme, unfortunately, reduces specific speed of the compressor machinery aspect with the adjunct result of reducing compressor efficiency. Reduced compressor efficiency, on the other hand, leads directly to increased drive power requirements (hence more load and heat generated within bearings, belt and idler) and increased discharge gas-air temperatures, resulting in even less cooling efficacy.

For the same reasoning, durability and life of the drive belt and the belt tensioning system, which consists of a bearing equipped idler pulley assembly, can also be extended if temperature rise in these components can be appropriately managed. Belt manufacturers, in fact, state that an 18° F. operating temperature rise within the belt may reduce life by a factor of one-half. Further, a 36° F. ambient temperature rise is sufficient to cause this 18° temperature rise. Thus, the ability to manage temperature within the drive belt assembly can be shown to promote longevity of the drive system proper.

The manufacturers which produce high-speed, belt-driven blowers (compressor) products employ either identical or very similar designs for the high-speed spindle arrangement. It should be noted that "high-speed" typically means speed ranges from 12,000 to 20,000 RPM, with new art arrangements having speeds up to 28,000 RPM. A typical prior art arrangement is depicted in FIGS. 1A and 1B. Such can be described as a simple two-bearing design with spring pre-load.

With reference to FIGS. 1A and 1B, the spindle assembly 1 includes a pulley 2 attached to a shaft 3 which extends to an impeller 4 of a centrifugal compressor of the blower device. Bearing elements 5 and 6 are spaced from one another and disposed between the shaft 3 and the housing 7. A spring 8 is used to pre-load at either end of the arrangement, at the pulley side in FIG. 1A, and at the impeller side in FIG. 1B.

It is common to position the spring 8 on the pulley side (as illustrated in FIG. 1), in the event that axial loads applied at the impeller 4 cause additional compression, with impeller movement away from any closely positioned housing surface. This effectively inhibits a "crash" of the impeller 4. Even so, any applied axial load which is sufficient to compress the spring 8 beyond its pre-loaded working height will effectively "unload" the bearing element 5 or 6 on the opposite end, leading to instability and potential failure. Since the spring 8 is typically linear in its response, the only way to prevent this occurrence is to incorporate additional pre-load, or, to position the spring 8 such that the opposite bearing 5 or 6 is the only bearing that carries any axial (thrust) load. Predicting and controlling thrust loads, due to aerodynamic characteristics of the impeller 4, is very difficult and highly dependent on the operating point of the compressor. In fact, even for the same compressor, thrust load direction may shift from one direction to the other simply by shifting to a different flow-pressure operating point.

Attempts to compensate for the un-loading of the opposite bearing, instability and rapid failures described above, by increasing spring pre-load of the spindle assemblies of prior art results in reduced operating life due to additional pre-load. Typical operating life for current art systems range from under 2,000 to approximately 6,000 hours, or less than one year if operating on a continuous basis.

Positioning the spring at the pulley end, which is typical, is potentially troublesome as the heavy belt load, considering applied radial loads, attempts to misalign the bearing races of the bearing elements 5 and 6 at the adjacent bearing, and hence "skew" the ball track. The spring 8 is the only functioning part of the system 1 which can apply sufficient axial load to maintain this alignment. Increasing spring pre-load necessarily compromises bearing life, due in part to elevated spring load. Attempting to add bearings, i.e., "duplex" them in order to improve load carrying characteristics of the individual bearings cannot be effectively accomplished with a spring-loaded system. This is due to the poor stiffness characteristics of the spring system. Typically, only one of the bearings will carry load while the second bearing simply "goes along for the ride".

It is, therefore, an object of this invention to incorporate a system which provides a separate, cool-air stream to the bearing assembly, for the purpose of controlling bearing temperature rise.

It is another object of this invention to provide a cool-air stream to the backside (or backplate) of the compressor housing itself, such that temperature rise due to the compressed air stream is effectively prevented from progressing towards the critical bearing mounting locations.

It is another object of this invention to provide a separate cool-air stream to the belt drive system, including the tensioning and idler pulley system, with the effect of controlling temperature rise in the drive belt and the idler pulley-bearing assembly.

It is another object of this invention to incorporate a fully enclosed drive system with cooling air entry and exhaust ports purposefully positioned to enable an efficient and highly effective cooling system.

It is another object of this invention to design the drive system enclosure such that entering cooling air may further be screened or filtered thus preventing debris from entering the system.

It is another object of this invention to incorporate sound absorbing and attenuating materials with cooling-air entry filtration.

It is another object of this invention to design the enclosure such that noise absorbing material may be conveniently applied to the enclosure interior, and manage noise which is developed in the drive-belt system, resulting in quieter system operation.

It is a further object of the present invention to incorporate an improved spindle assembly, wherein a rigid pre-load design is implemented which enables the use of additional bearings to improve load carrying characteristics and operating life of the system.

The present invention accomplishes these objects and provides other related advantages.

SUMMARY OF THE INVENTION

The present invention resides in a high-speed, belt-driven centrifugal blower having design characteristics which markedly improve life expectancy.

In one embodiment, the blower incorporates a self-contained air cooling system. The blower generally comprises a housing having air inlet and outlet apertures. Typically, the housing is comprised of a mounting plate and a cover attached to the mounting plate. Inlet apertures are typically formed in the cover, and the outlet apertures are formed in the mounting plate. To reduce noise, the cover preferably includes a sound dampening material.

A drive assembly is connected to a drive motor and disposed within the housing. A centrifugal compressor is connected to the drive assembly and disposed exteriorly to the housing adjacent to the outlet apertures. Air flows through the air inlet apertures, over the drive assembly and exit through the outlet apertures to cool various components of the drive assembly.

The drive assembly comprises a drive pulley rotatably connected to the drive motor. The drive pulley includes fan blades which draw air into the housing. As such, the drive pulley is positioned adjacent to the housing air inlet apertures.

A spindle assembly is connected to the centrifugal compressor and at least partially disposed within the housing. Typically, the spindle assembly is disposed adjacent to the outlet apertures of the housing. Cooling fins may extend from a housing of the spindle assembly to further cool the assembly. Air vents are also preferably formed in the spindle assembly housing.

A belt interconnects the drive pulley and a pulley of the spindle assembly, which powers the centrifugal compressor. A belt tensioning assembly is typically connected to the belt, and includes an automatic belt tensioner coupled to an idler. As described above, as the drive pulley is rotated by the drive motor, the belt causes a shaft of the spindle assembly to rotate and power the centrifugal compressor. Rotation of the drive pulley also causes air to enter the housing through the inlet apertures, flow over the belt and spindle assembly, and exit through the outlet apertures, thus cooling the entire drive assembly and prolonging the life of the blower.

In another embodiment, the blower incorporates a spindle assembly having a rigid bearing arrangement. The spindle assembly generally comprises a housing having a pulley end portion and an impeller end portion. A rotatable shaft extends through the housing to interconnect the pulley and the impeller. A bearing element is disposed between the shaft and the housing at the pulley end portion, and a bearing element is disposed between the shaft and the housing at the impeller end portion. The bearing elements comprise ball bearings disposed between inner and outer races, having offset grooves formed therein. Typically, the bearing elements are angular contact-type. Preferably, multiple bearing elements are disposed at either or both ends. The use of multiple bearing elements allows load sharing and enables reduction of load on any individual bearing, and hence a reduced fraction of dynamic load rating capacity. This results in markedly improved life expectancy.

A spacer set is disposed between the bearing elements, and a lock axially secures the bearing elements and spacer set rigidly in place. The lock preferably comprises a pre-loading ring, disposed between the pulley, and in contact with at least a portion of the bearing at the pulley end portion. The pulley fastener may be tightened to a predetermined torque for optimal pre-loading.

A seal is disposed between the pulley and the housing of the spindle assembly to prevent unwanted foreign matter and debris from entering the assembly. The seal may comprise a lip or controlled-gap seal. Alternatively, the seal comprises a labyrinth seal.

To cool the spindle assembly, air vents are formed in the housing thereof. Also, the spindle assembly housing includes an inner sleeve comprised of a metal having a first coefficient of thermal expansion similar to the other internal components, and an outer casing attached to the inner sleeve and comprised of a metal having a second coefficient of thermal expansion. This enables heat dissipation while maintaining the rigid pre-loading arrangement described above.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1A:
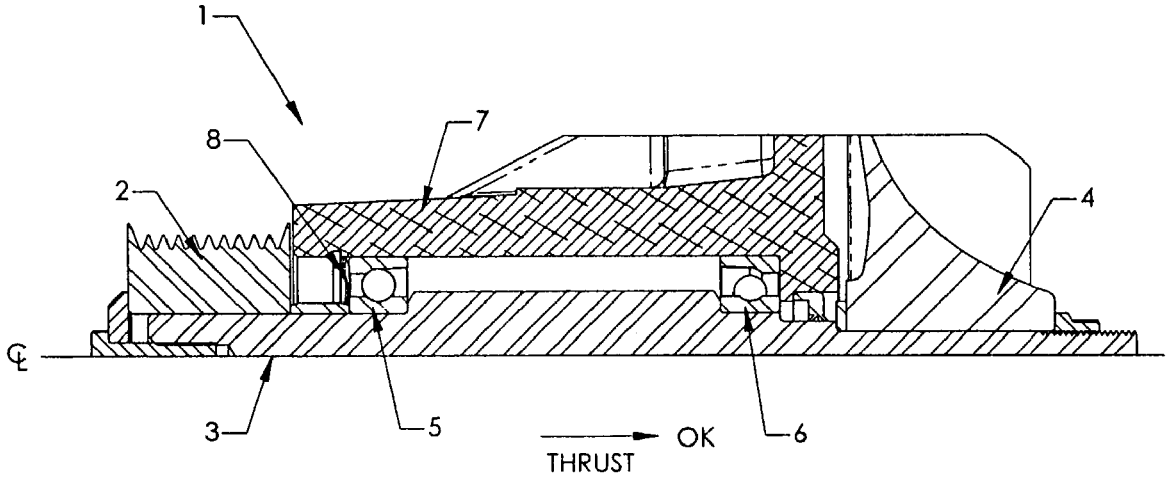
FIGURE 1A PRIOR ART
FIGS. 1A and 1B depict cross-sectional views of spindle assemblies used in prior art centrifugal blowers.
Figure 1B:
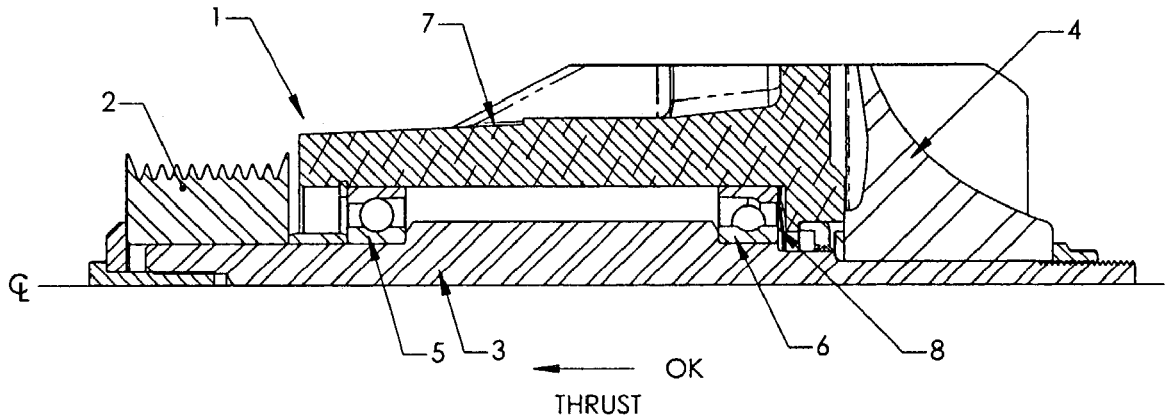
FIGURE 1B PRIOR ART

The present invention resides in a belt-driven industrial blower, generally referred to by the reference number 10 incorporating a self-contained air cooling system 12 for cooling various components of the blower 10 to prolong the longevity and useful life of the blower 10.

With reference now to FIGS. 2–5, the blower 10 includes an electric drive motor 14 having mounting supports 16 for attachment to the intended mounting surface, typically a floor. The mounting support 16 may include springs or dampeners for isolating the blower 10 from its surrounding to the greatest extent possible. A housing 18 has a back plate or mounting plate 20 thereof attached to the electric drive motor 14. A cover 22 of the housing 18 is removably attached to the mounting plate 20 by appropriate fasteners 24, such as nuts threaded onto bolts extending from the mounting plate 20. The cover 22 is preferably manufactured from robust, but sound absorbing/attenuating materials, for example, rota-molded cross-linked polyethylene. Noise attenuating materials 23, such as those designed specifically for absorption and transmission reduction, i.e., an absorber/barrier construction are preferably applied to the interior of the cover 22. This allows the cover 22 to be comprised of other materials, such as metal. The cover 22 includes a plurality of apertures 26, such as the illustrated concentrically arranged ports (although other port patterns are acceptable), that serve as air inlets to the housing 18.

Figure 5:
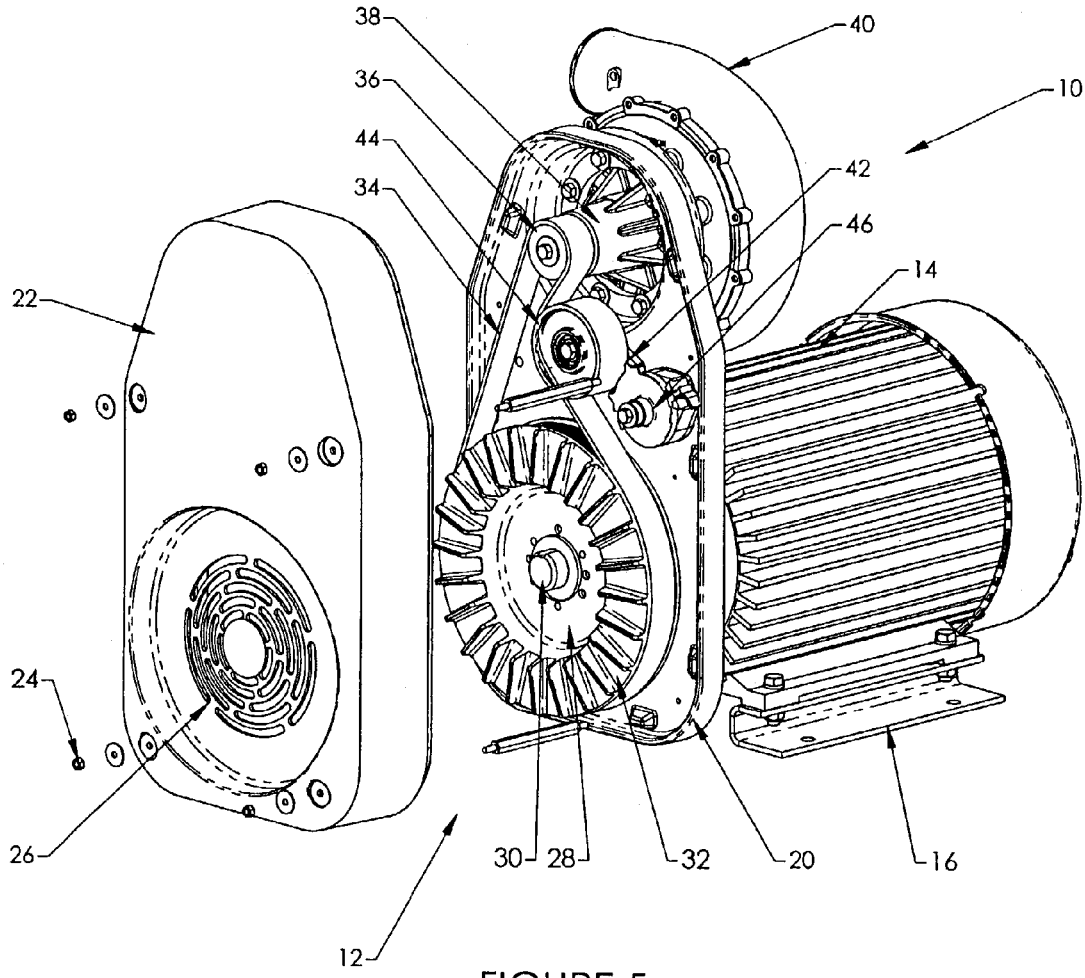
FIG. 5 is a partially exploded front perspective view of the blower of FIG. 2, illustrating a cover of the housing thereof removed.

As illustrated in FIG. 5, a drive assembly is connected to the drive motor 14 and disposed within the housing 18. The drive assembly is comprised of a drive pulley 28 rotatably connected to a shaft 30 extending from the drive motor 14. The drive pulley 28 includes a plurality of fan blades 32, such as the illustrated radial fins in FIG. 5. Although the blades 32 of the pulley 28 may be radially oriented, hence allowing equal performance in either rotational direction, the blades may alternatively be back swept in one direction or the other with corresponding rotation being restricted to the direction that the back swept blade is designed for. A belt 34 interconnects the drive pulley 28 and a pulley end 36 of a spindle assembly 38. The spindle assembly 38 powers a compressor 40, which is disposed exteriorly to the housing 18. Preferably, the blower 10 includes a tension assembly 42 including an idler 44 and tensioner 46 for properly adjusting the tension of the belt 34 during the operation of the blower 10.

Figure 2:
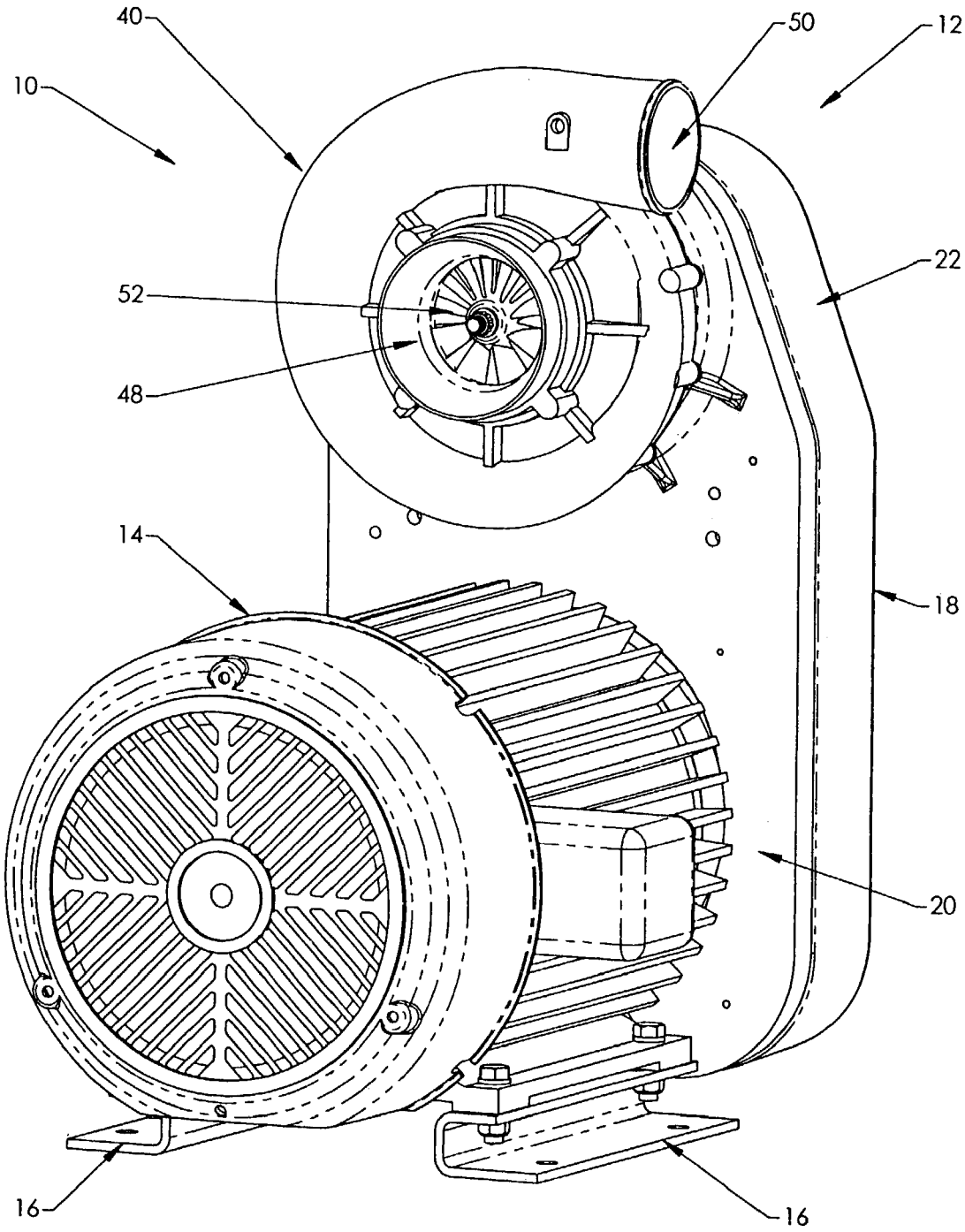
FIG. 2 is a rear perspective view of a belt-driven centrifugal blower embodying the present invention and incorporating a self-contained air cooling system.
Figure 3:
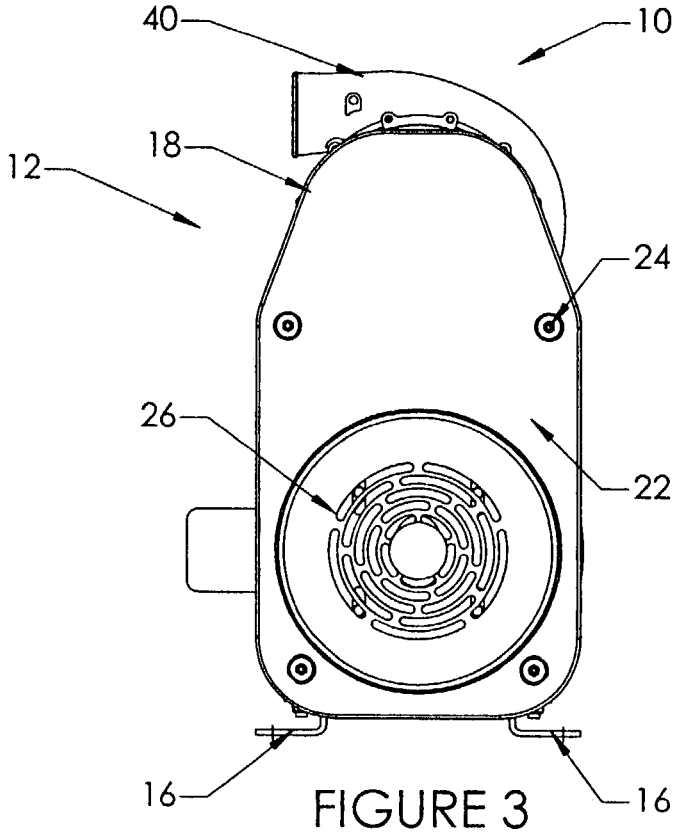
FIG. 3 is a front elevational view of the blower of FIG. 2.
Figure 4:
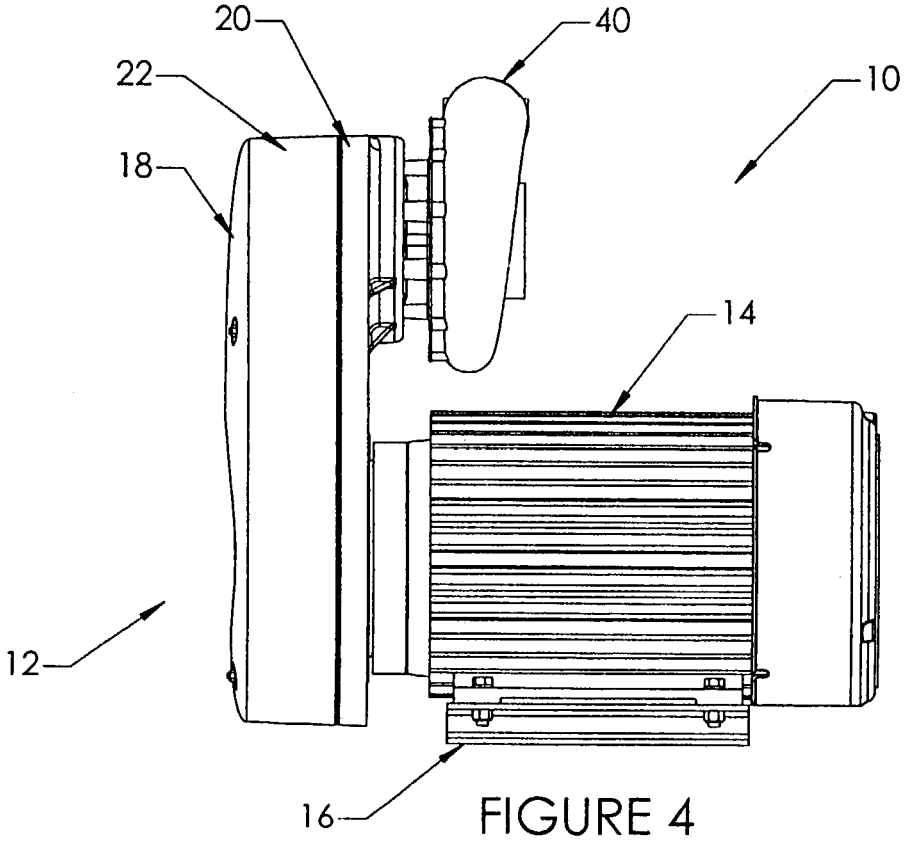
FIG. 4 is a side elevational view of the blower of FIG. 2.
Figure 6:
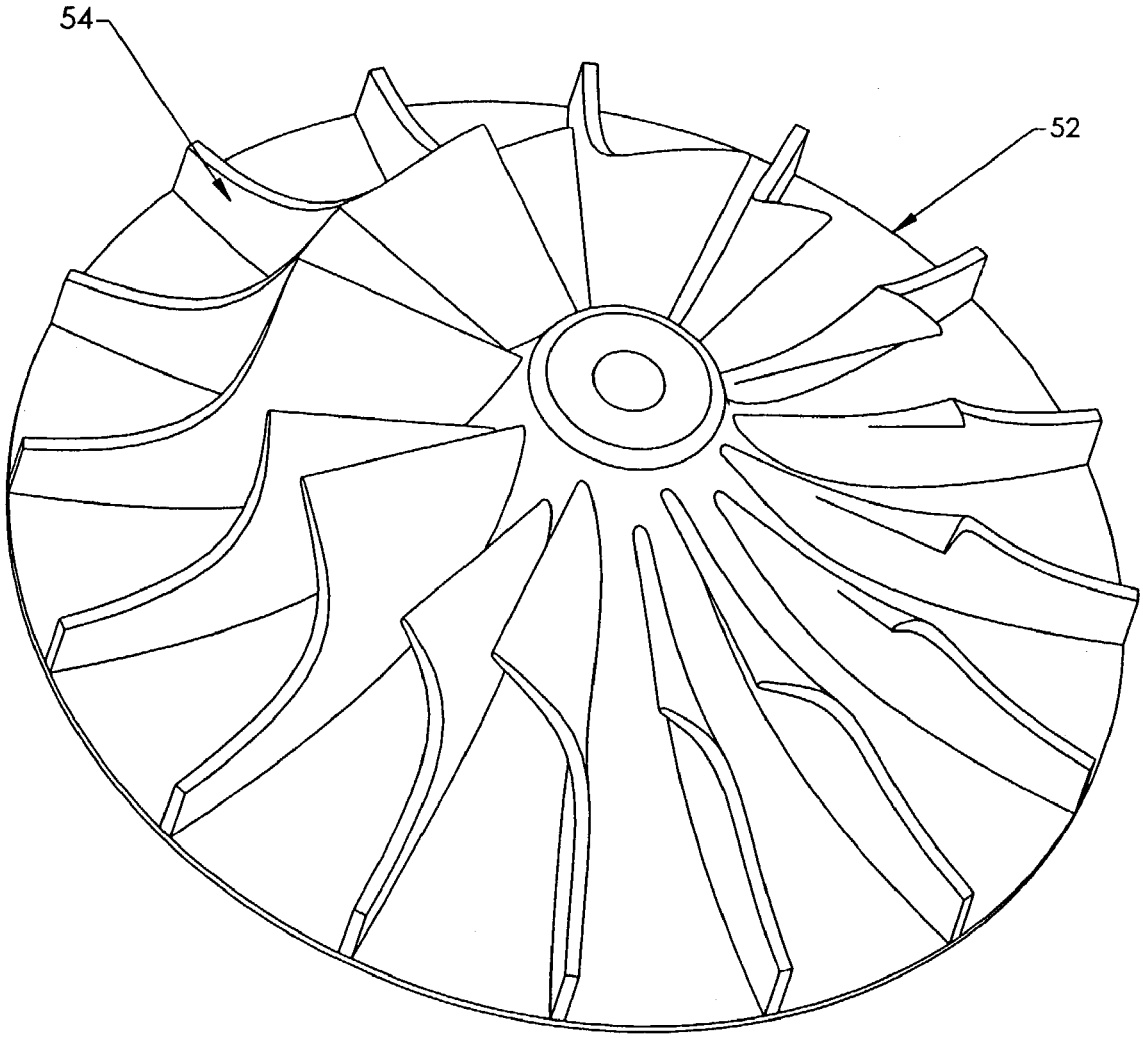
FIG. 6 is a perspective view of an impeller used in a compressor of the blower of the present invention.

With reference now to FIGS. 2 and 6, the compressor device 40 includes an air inlet 48 and an air outlet 50. An impeller 52 is housed within the compressor 40 immediately behind the air inlet 48 for drawing air through inlet 48 so as to compress the air and impart speed thereto as it exits through outlet 50.

Figure 7:
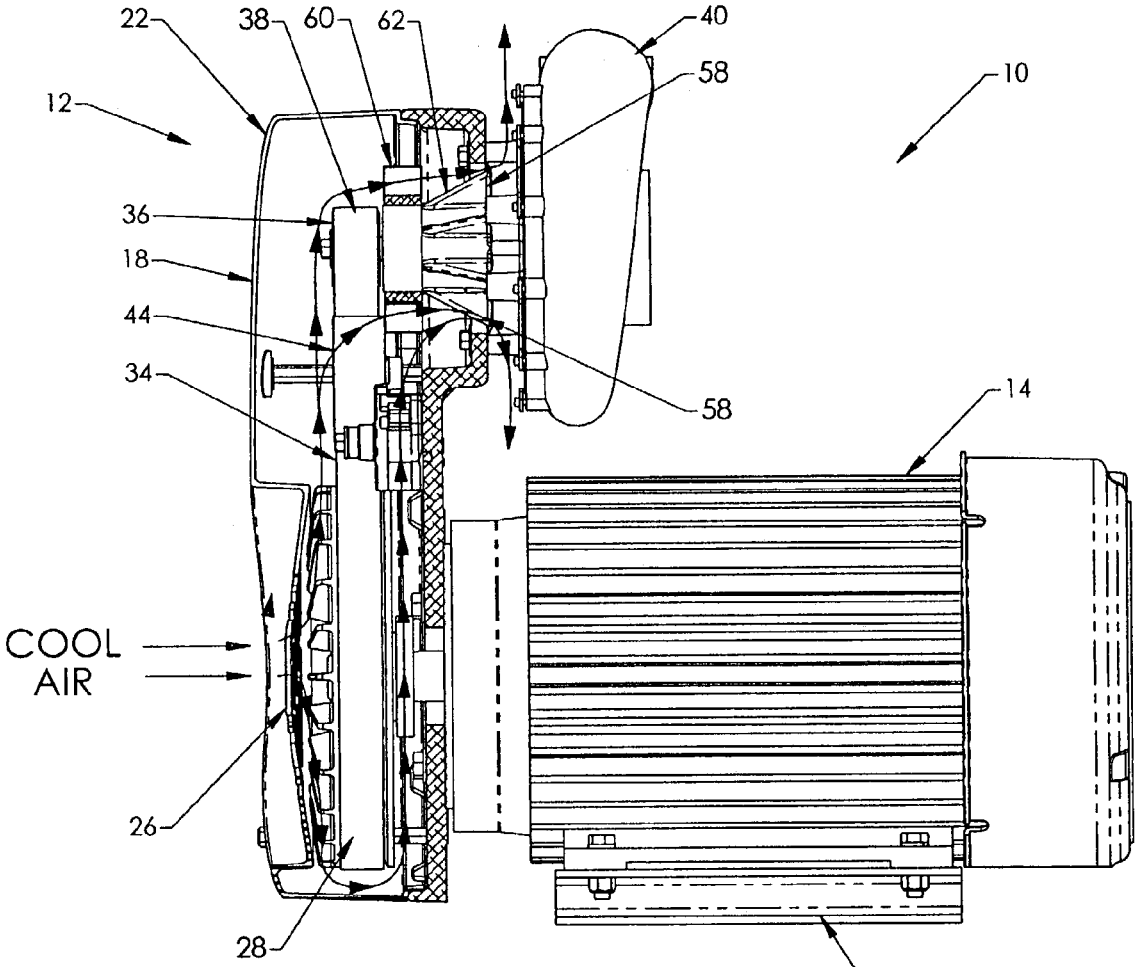
FIG. 7 is a partially sectioned side view of the blower of the present invention, illustrating the flow of air therethrough.
Figure 8:
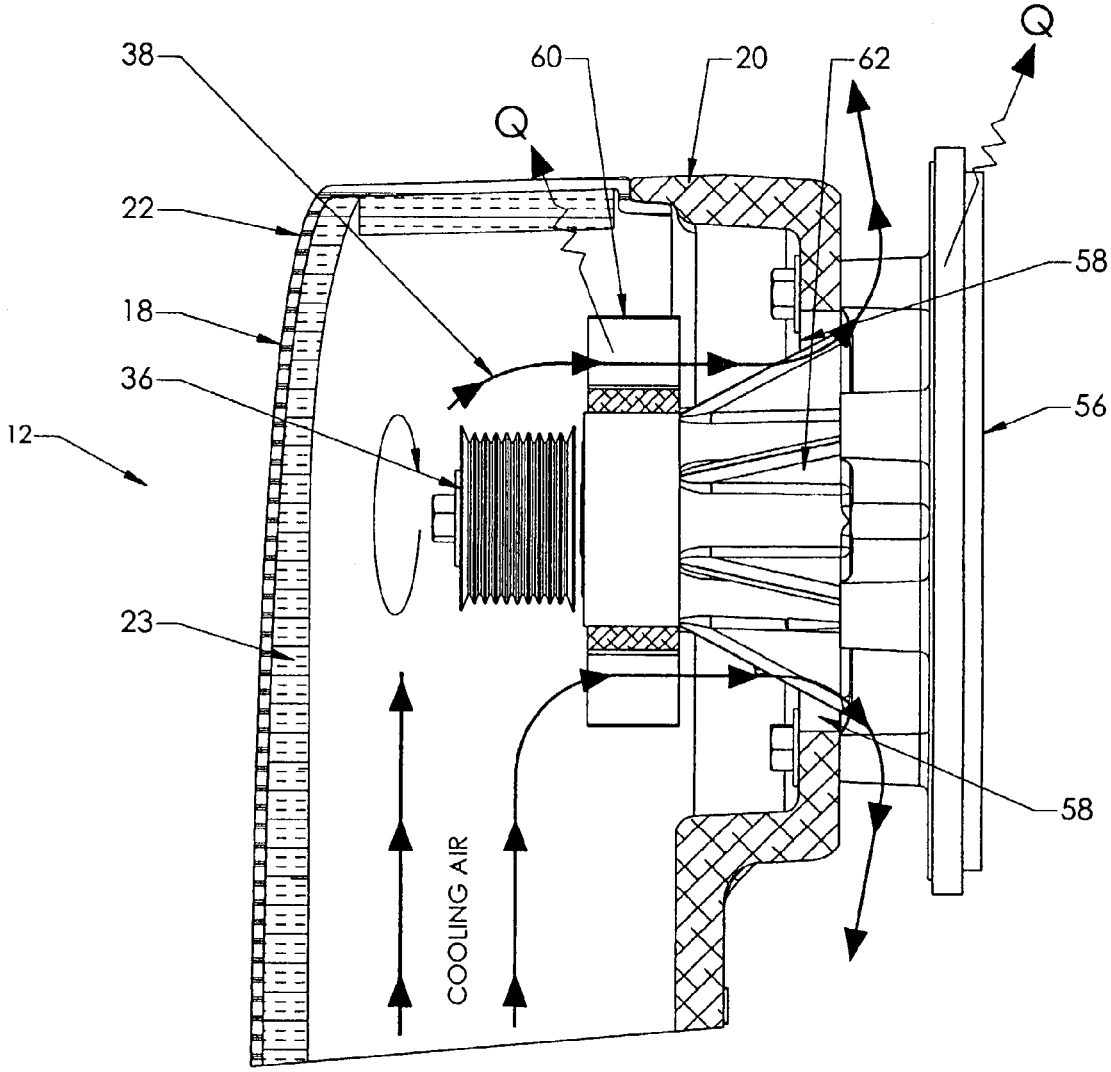
FIG. 8 is an enlarged and partially fragmented sectional view illustrating flow of air over a spindle assembly thereof.

With reference now to FIGS. 7 and 8, the spindle assembly 38 includes a back plate 56 which extends outwardly from the mounting plate 20 of the housing 18. The majority of the spindle assembly 38, including a bearing assembly portion thereof, is disposed within the housing 18 so that it may be cooled, as will be described more fully herein. The compressor 40 attaches to back plate 56 and is disposed outside of the housing 18 so that the heated compressed air therein can be isolated from the remaining components of the drive assembly.

With continuing reference to FIGS. 7 and 8, in operation, the drive motor 14 rotates drive pulley 28, causing the belt 34 to rotate the pulley 36 of the spindle assembly 38 and thus a shaft extending therethrough to the impeller 52 of the compressor 40 to drive and power the compressor 40. The rotation of the drive pulley 28 also causes cool ambient air to enter through inlet apertures 26 of the cover 22, flow over the belt 34 and spindle assembly 38 before exiting through outlet apertures 58 formed between the spindle assembly 38 and back mounting plate 20 of the housing 18. Preferably, a filter (not shown) is placed adjacent to the inlet ports 26 to filter the incoming air and prevent harmful debris from becoming lodged in the various components of the drive assembly. It will be noted that the only escape route takes the clean air stream directly past the spindle assembly 38, which impinges against the compressor back plate 56. Thus, the belt 34, tensioning system 42 and spindle assembly 38 are cooled through forced convective means, thus managing the temperature rise of the critical bearing elements of the spindle assembly 38. Thus, as the compressed air within the compressor 40 heats the housing 18 internally, the cooling air stream carries this heat away and thus prevents thermal migration towards the critical bearing assembly areas of the spindle assembly 38.

To further facilitate the removal of heat therefrom, the housing of the spindle assembly 38 may include heat dissipating fins 60 or the like extending therefrom, or clamped thereto for further dissipating heat "Q". Additional webbing or fins 62 may also be provided. Moreover, the housing of the spindle assembly 38, as well as the back plate 56, may be comprised of metals which facilitate heat dissipation, such as aluminum.

Tests have shown that this system 12 is quite effective. Temperature probes mounted directly on the spindle assembly 38, just outboard of the outer bearing race, verify that the assembly 38 may run as much as 65° F. cooler than the compressed air stream, measured at the discharge outlet 50 of the compressor 40. Compared to tests run without the cooling feature, spindle housing 38 running temperatures are approximately 20° F. lower. Compared to current art, bearing operating temperatures are estimated at 40° F. to 50° F. lower. At the 23,000 RPM operating point, bearing temperatures will typically run only 30–35° F. above the ambient. As even a 20° F. increase in running temperature will reduce grease life by a factor of one-half and an 18° F. temperature rise in the belt can cut belt life in one-half, it will be appreciated by those skilled in the art that the self-contained air cooling system 12 of the present invention can significantly improve the operating life of the blower 10.

With reference now to FIGS. 9–16, a high-speed spindle and housing arrangement is illustrated for such compact, belt-driven centrifugal blowers 10 illustrated and described above. The spindle assembly 38 described herein pertains primarily to oil-less or grease-lubricated assemblies as lubricating fluids which may enter the air stream in the event of a seal failure, for example, cannot be tolerated. Thus, even though wet lubricated bearing and/or transmission drive systems are commonly employed for industrial compressor products and machine tools, the assembly 38 illustrated and described herein pertains to grease-lubricated assemblies.

Figure 9:
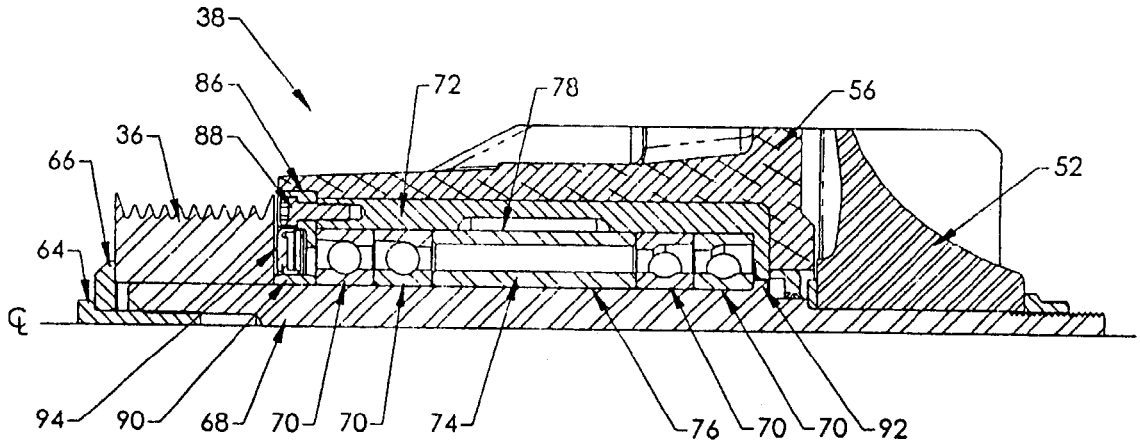
FIG. 9 is a cross-sectional view of a spindle assembly having a rigid bearing arrangement in accordance with the present invention.
Figure 10:
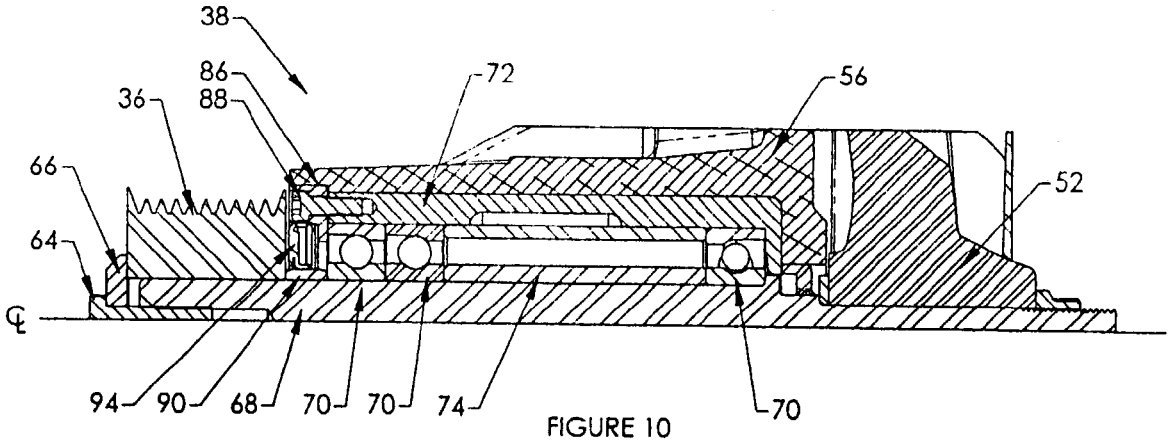
FIG. 10 is a cross-sectional view of another spindle assembly embodying the present invention.
Figure 13:
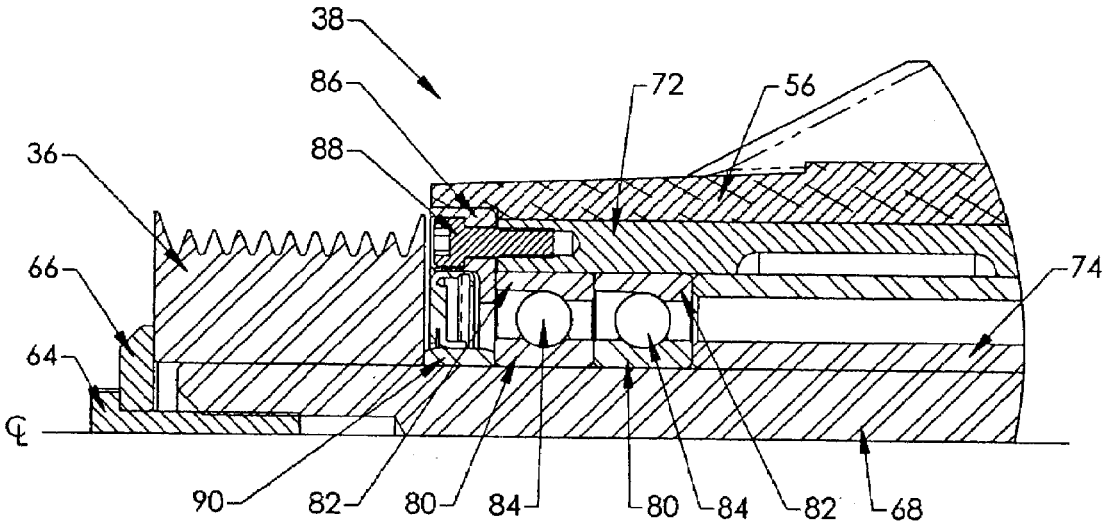
FIG. 13 is an enlarged, partially fragmented and cross-sectional view of a spindle assembly embodying the present invention, illustrating component parts thereof, including a lip-type seal.

With reference now to FIG. 9, the spindle assembly 38 includes a pulley 36, which engages belt 34, at one end thereof. A pulley fastener 64, such as a bolt and washer 66 interconnect the pulley 36 and a shaft 68 which extends through the spindle assembly 38 to an attachment with the impeller 52. As the pulley 36 is rotated, the shaft 68, and thus the impeller 52, are rotated. Bearing elements, generally referred to by the reference number 70 are disposed between the shaft 68 and an inner sleeve 72 of the housing of the spindle assembly 38. At least one bearing element 70 is disposed adjacent to the pulley 36 end of the assembly 38, and at least one bearing element 70 is disposed adjacent to the impeller 52 end of the assembly 38. Each bearing element 70 is comprised of an inner race 80 and an outer race 82 having a bearing 84 disposed therebetween, as illustrated in FIG. 13. Angular contact-type bearings are preferred.

A spacer set 74 comprised of inner and outer spacer elements 76 and 78 are disposed between the bearing elements 70. The tubular spacers 76 and 78 intermediate the bearing elements 70 must be precisely flush and parallel to each other in order to incorporate assembled pre-load of the bearing system appropriately.

Each bearing element 70 incorporates a precise amount of offset-grind, or grooves, on the inner/outer race 80 and 82 faces. When assembled and clamped together, these offset gaps are closed with the pre-load force being precisely determined by the displacement. However, the bearings 84 themselves may be obtained in "flush" sets, i.e. no offset-grind incorporated, with the spacers 74 instead incorporating the necessary offset grind.

With particular reference to FIGS. 9 and 13, a retainer 86 is secured to housing liner 72, such as by fastener 88 threadedly received through retainer 86 and into the housing 72 such that the retainer 86 contacts at least a portion of the outer bearing element 70 to retain the bearing elements 70 and spacer 74 within the housing 72 in a rigid and secure manner. A seal/pre-loading ring 90 is disposed between the pulley 36 and inner race 80 of the outermost bearing element 70 such that as fastener 64 is tightened, the bearing element 70 and spacer 74 are compressed against shaft shoulder 92 and rigidly held in place within the assembly 38.

Thus, the clamping/pre-loading function is achieved by the pulley fastener 64, which clamps pulley 36, seal/pre-loading ring 90, bearing inner races 80 and inner tubular spacer 76 all being interacted by shaft shoulder 92. In a particularly preferred embodiment, the fastener is a ¼-28 UNF size, although other sizes can be employed in the range of #10 screw size up to ½" diameter. The ¼-28 fastener is torqued to 100 lb-in, with a range of 20 to 200 lb-in torque being applicable to develop from 400 to 4000 lbs of compressive load. Clearly, other size fasteners would necessarily require different torque values. The design is entirely robust for applied axial loads in either direction.

The bearing element 70 may be duplexed or arranged in "tandem" pairs at both ends of the spindle, as illustrated in FIG. 9, so that the bearing elements 70 appropriate share load due to the "rigid" pre-loading arrangement. Thus, in any conceivable loading situation, there are two bearing elements sharing load for the heavy radial belt load, and two bearing elements 70 sharing any applied thrust load, regardless of direction. It has been found that under grease-lubricated conditions, the speedability of the system is entirely within limits at the intended upper speed of 30,000 RPM, corresponding to a dN of 600,000. Design life is markedly improved, exceeding 20,000 hours, or in excess of three times that of the prior art.

Figure 11:
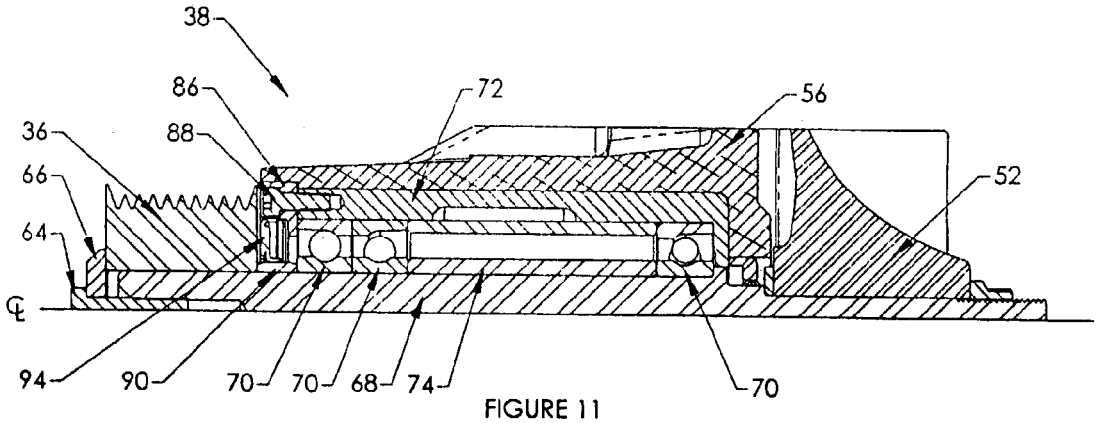
FIG. 11 is a cross-sectional view of yet another spindle assembly embodying the present invention.
Figure 12:
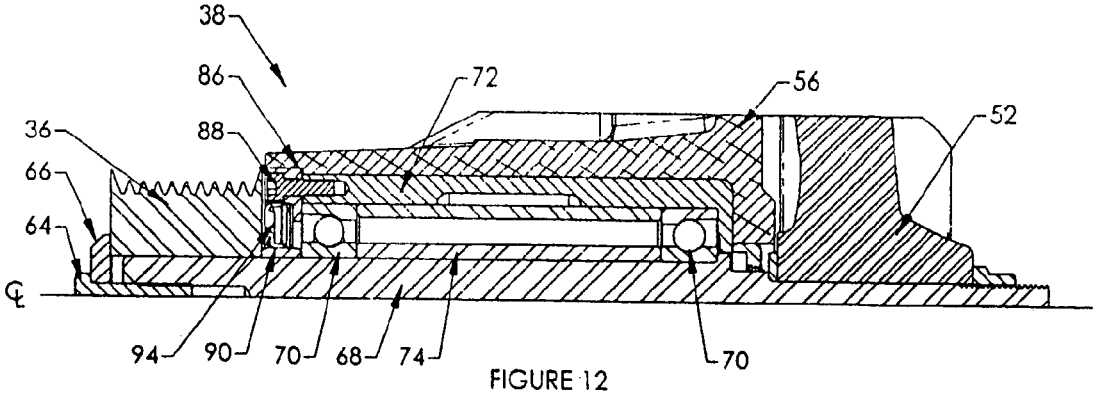
FIG. 12 is a cross-sectional view of another spindle assembly embodying the present invention.

It should be noted that other embodiments of the present invention can be realized, all within the scope and spirit of the invention. Such would include, but not necessarily limited to, the arrangement depicted in FIGS. 10–12. These arrangements incorporate fewer bearing elements 70, and hence benefit from reduced costs associated therewith. The three bearing arrangement of FIG. 10 incorporate a tandemed-duplexed bearing set at the pulley end, and therefore benefit from sharing the heavy radial belt load. Alternatively, the duplexed bearings can be arranged "back-to-back", as illustrated in FIG. 11, to provide different characteristics. In FIG. 12, a single bearing at either end would effect the lowest cost arrangement, suitable for carrying reduced power, and appropriate for smaller compressor products. However, all arrangements are robust for applied thrust loads in either direction, unlike the current art-spring loaded arrangement.

Another intent of the present invention is to provide means for retaining the entire spindle assembly within its housing, and provide at the same time means for sealing the sensitive bearing element 70 from outside contaminants. The clamping/retaining ring 86 is designed to provide both functions. The retainer 86 is attached to the housing 72 via a fastener 88, such as the illustrated screw. The retainer incorporates a gland which accommodates a seal element 94. The seal element 94, as disclosed in FIGS. 9–13, may be of a lost-cost contacting lip-type, or a non-contacting controlled-gap type. The seal is easily maintained by removal of the clamping retaining ring 86 and the refitting of a new seal element 94.

For the same reasons as explained above, the selection, quantity and fastening torque of the attaching screw 88 are all crucial parameters of the present design. In the preferred embodiment, five screws of 8–32 size are employed with a fastening torque specification of 20 lb-in, with a torque range of 5 to 100 lb-in being applicable. Clearly, other attachments screws in size and quantities may be selected and be within the scope of the present invention. It should also be noted that a threaded ring may be employed in lieu of the ring with separate attachment screws 88.

Figure 14:
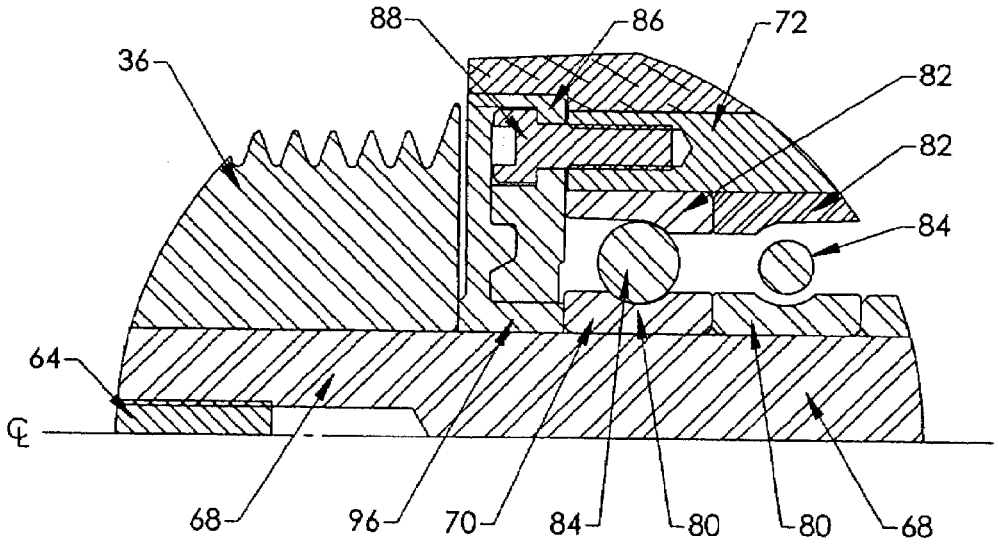
FIG. 14 is an enlarged and partially fragmented and cross-sectional view of a spindle assembly embodying the present invention, illustrating component parts thereof, including a labyrinth seal.

With reference now to FIG. 14, an alternative embodiment is illustrated wherein both the inner and outer race clamping-retaining functions are effected by a multi-function clamping and sealing arrangement. An outer clamping ring 96 interfaces with an inner clamping ring 86 to form a integral labyrinth seal. Both clamping rings 86 and 96 bear against the bearing element 70, thus, these two contact points form and share a precise datum plane. The two clamping ring-labyrinth seal elements 86 and 96, then, are precisely positioned relative to each other, and hence a very tight operating gap between them can be maintained. This enables a very effective labyrinth sealing function. Several advantages are obtained in this arrangement, including the fact that the inner clamping ring 86 need not be of hardened and ground construction to accommodate a contacting lip seal 94, for wear reasons. The number of parts are also reduced in number. The non-contacting feature of the labyrinth inures to virtually infinite life, and eliminates a source of heat in the case of a contacting lip. A clear benefit is obtained as the inner-to-outer race temperature gradient is dramatically reduced. In this event, thermally induced preload effects are managed, if not entirely eliminated. Tests have shown that such an arrangement of inner-to-outer race temperature differentials of 20–22° F. are reduced to approximately 8° F. It will be appreciated by those skilled in the art that either sealed bearing elements or "open" bearings can be utilized in the spindle assembly 38.

Figure 15:
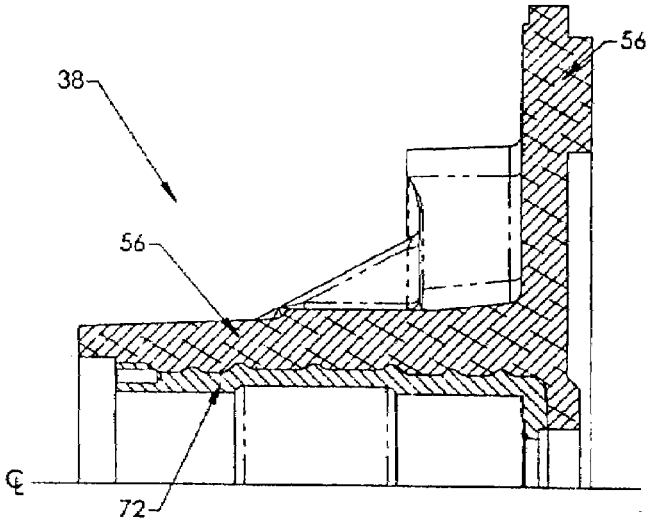
FIG. 15 is a cross-sectional view of a housing of the spindle assembly of the present invention, illustrating the use of different metals therein.

With reference now to FIG. 15, the benefit of using bearing housing material constructed from aluminum is evident from its improved thermal conductivity properties and low cost/ease of manufacture. Heat is conveniently conducted away from such aluminum material and rejected convectively at the outer surface by the forced air cooling means described above. However, the use of aluminum adjacent to an interfacing with the ferrous bearing element 70 can present problems, primarily due to its increased coefficient of thermal expansion over ferrous-based materials. As such, bearing fit and clamping retention forces cannot be maintained at all conceivable operating temperatures if the housing and bearing bore is able to move relative to the bearing elements 70 themselves.

Thus, the present invention employs an integral ferrous sleeve 72 having a similar or identical coefficient of thermal expansion and conductivity as the internal bearing elements 70 and spacers 74. Thus, the thermally induced growth or shrinkage of the these components is matched by the housing liner 72 due to the similar coefficients of thermal expansion. Cast aluminum 56 is over-molded around the cast ferrous liner 72, the resulting construction comprising a single composite casting, as illustrated in FIG. 15. The ferrous liner material 72 is selected to provide the desired thermal coefficient match, good thermal conductivity to promote cooling, as well as for suitability for use with bearing systems as the housing material. In the preferred embodiment, gray iron Grade G2 is selected, noting that other ferrous materials may be equally well suited and all within the scope and spirit of the present invention. A clear advantage to the composite cast construction of the present invention is its ease of manufacture, with little if any increase in costs associated with finish machining operations.

Another problem encountered with prior art spindle assemblies 38 is that when operating at higher temperature and fully sealed, the assembly 38 housing will tend to self-pressurize as it warms. Aggressive sealing must be incorporated to prevent bearing lubricant from being "blown" out of the ends of the spindle and potentially into the working air stream. However, incorporating aggressive positive sealing means necessarily incurs increased frictional losses and increased seal wear rates. Heat generated by seals has been shown to elevate bearing running temperatures at the inner race 80, with associated life impacting consequences.

Figure 16:
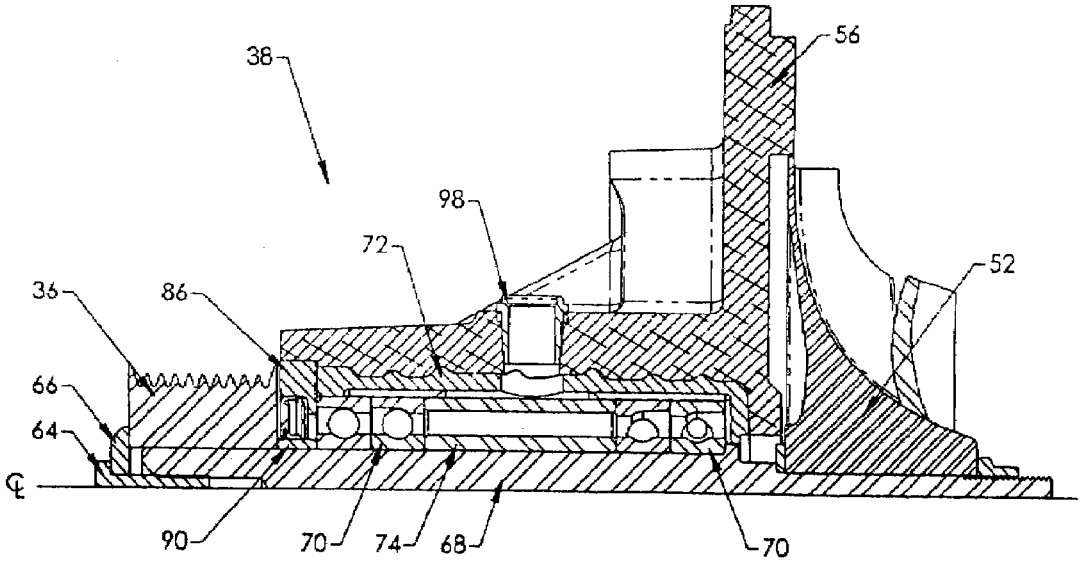
FIG. 16 is a cross-sectional view of the spindle assembly embodying the present invention, illustrating a vent formed in the housing thereof.

Thus, it is an object of the present invention to incorporate a vented bearing housing which effectively and necessarily precludes large differential pressures from developing within the housing. As shown in FIG. 16, bearing housing 56 and 72 includes a vent 98 which extends through the aluminum cast 56 and inner sleeve 72 to air gaps within the assembly 38 adjacent to the bearing element 70 and spacer 74. Internal pressures which may develop inside the rigid spindle assembly 38 are conveniently vented through the bearings, communicated through the air grooves, and vented to the vent 98. To ensure adequate venting performance and to simultaneously preclude entry of contaminants into the vented housing cavity, vent 98 preferably incorporates a filtration means wherein the filter is preferably comprised of a porous metallic media. In the preferred embodiment, this porous metallic media has a particulate rating of under 10-micron, but may range up to 40-micron.

Although several embodiments have been described in detail for purposes of illustration, various modifications may be made without departing from the scope and spirit of the invention. Accordingly, the invention is not to be limited, except as by the appended claims.

What is claimed is:

1. A belt-driven centrifugal blower incorporating a self-contained air cooling system, the blower comprising:

a housing having air inlet and outlet apertures;

a drive assembly connected to a drive motor and disposed within the housing; and a centrifugal compressor connected to the drive assembly and disposed exteriorly to the housing adjacent to the outlet apertures, the centrifugal compressor extending away from the housing and including a backplate spaced apart from the housing;

wherein air flows through the air inlet apertures, over the drive assembly and exits the housing through the outlet apertures so as to at least partially flow over the compressor backplate to remove heat therefrom.

2. The blower of claim 1, wherein the drive assembly comprises a drive pulley rotatably connected to the drive motor, a spindle assembly connected to the centrifugal compressor and at least partially disposed within the housing, and a belt interconnecting the drive pulley and the spindle assembly for powering the centrifugal compressor.

3. The blower of claim 2, wherein the drive pulley includes fan blades.

4. The blower of claim 3, wherein the drive pulley is positioned adjacent to the housing air inlet apertures.

5. The blower of claim 2, wherein the drive assembly further comprises a belt tensioning assembly connected to the belt.

6. The blower of claim 5, wherein the tensioning assembly comprises an automatic belt tensioner coupled to an idler.

7. The blower of claim 1, wherein the housing is comprised of a mounting plate and a cover attached to the mounting plate.

8. The blower of claim 7, wherein the inlet apertures are formed in the cover and the outlet apertures are formed in the mounting plate.

9. The blower of claim 7, wherein the cover includes sound dampening material.

10. The blower of claim 2, including cooling fins extending from a housing of the spindle assembly.

11. The blower of claim 2, including air vents formed in a bearing housing of the spindle assembly.

12. The blower of claim 2, wherein the spindle assembly includes a housing having an inner sleeve comprised of a metal having a first coefficient of thermal expansion, and an outer casing attached to the inner sleeve and comprised of a metal having a second coefficient of thermal expansion.

13. The blower of claim 12, wherein the inner sleeve is comprised of a material having a similar or identical coefficient of thermal expansion and conductivity as internal bearing elements and spacers of the spindle assembly.

14. The blower of claim 13, wherein the inner sleeve is comprised of a ferrous-based material, and the outer casing is comprised of an aluminum-based material over-molded onto the inner sleeve.

15. The blower of claim 2, wherein a spindle of the spindle assembly does not include an air passageway therethrough.

16. The blower of claim 7, wherein the mounting plate and cover of the housing have a generally vertical configuration, and the spindle assembly is disposed above the drive pulley within the housing.

17. A belt-driven centrifugal blower incorporating a self-contained air cooling system, the blower comprising:

a housing having air inlet and outlet apertures;

a spindle assembly at least partially disposed within the housing adjacent to the outlet apertures;

a centrifugal compressor operably connected to the spindle assembly and disposed exteriorly to the housing and extending away from the housing such that a backplate thereof is spaced from the housing;

a drive pulley including fan blades disposed within the housing adjacent to the inlet apertures and rotatably connected to a drive motor; and a belt interconnecting the drive pulley and a pulley of the spindle assembly;

wherein rotation of the drive pulley by the drive motor causes a shaft of the spindle assembly to operably rotate and power the centrifugal compressor; and wherein rotation of the drive pulley causes air to enter the housing through the inlet apertures, flow over the belt and spindle assembly and exit the housing through the outlet apertures and flow over the compressor backplate to remove heat therefrom.

18. The blower of claim 17, wherein the drive assembly further comprises a belt tensioning assembly connected to the belt.

19. The blower of claim 18, wherein the tensioning assembly comprises an automatic belt tensioner coupled to an idler.

20. The blower of claim 17, wherein the housing is comprised of a mounting plate defining the outlet apertures, and a cover attached to the mounting plate and defining the inlet apertures.

21. The blower of claim 20, wherein the cover includes sound dampening material.

22. The blower of claim 17, including cooling fins extending from a housing of the spindle assembly.

23. The blower of claim 17, including air vents formed in a bearing housing of the spindle assembly.

24. The blower of claim 17, wherein the spindle assembly includes a housing having an inner sleeve comprised of a metal having a first coefficient of thermal expansion, and an outer casing attached to the inner sleeve and comprised of a metal having a second coefficient of thermal expansion.

25. The blower of claim 17, wherein the spindle assembly includes a housing having an inner sleeve comprised of a metal having a first coefficient of thermal expansion similar or identical to internal bearing elements and spacers of the spindle assembly, and an outer casing attached to the inner sleeve and comprised of a metal having a second coefficient of thermal expansion.

26. The blower of claim 25, wherein the inner sleeve is comprised of a ferrous-based material, and the outer casing is comprised of an aluminum-based material over-molded onto the inner sleeve.

27. A belt-driven centrifugal blower incorporating a self-contained air cooling system, the blower comprising:

a housing having a generally vertical configuration and including a mounting plate having air outlet apertures and a cover attached to the mounting plate having air inlet apertures;

a drive pulley including fan blades disposed within the housing adjacent to the inlet apertures and rotatably connected to a drive motor;

a spindle assembly at least partially disposed within the housing above the drive pulley and adjacent to the outlet apertures;

a centrifugal compressor operably connected to the spindle assembly and disposed exteriorly to the housing and extending away from the housing such that a backplate thereof is spaced from the housing;

a belt interconnecting the drive pulley and a pulley of the spindle assembly;

wherein rotation of the drive pulley by the drive motor causes a shaft of the spindle assembly to operably rotate and power the centrifugal compressor; and wherein rotation of the drive pulley causes air to enter the housing through the inlet apertures, flow over the belt and spindle assembly and exit the housing through the outlet apertures and flow over the compressor backplate to remove heat therefrom.

28. The blower of claim 27, wherein the drive assembly further comprises a belt tensioning assembly connected to the belt.

29. The blower of claim 28, wherein the tensioning assembly comprises an automatic belt tensioner coupled to an idler.

30. The blower of claim 27, wherein the housing includes sound dampening material.

31. The blower of claim 27, including cooling fins extending from a housing of the spindle assembly.

32. The blower of claim 27, including air vents formed in a bearing housing of the spindle assembly.

33. The blower of claim 27, wherein a spindle of the spindle assembly does not include an air passageway therethrough.

* * * * *